US005339578A

United States Patent [19]

Smerchanski et al.

[11] Patent Number: 5,339,578

[45] Date of Patent: Aug. 23, 1994

[54] SUPPORT FORM FOR A GRADE BEAM OR SLAB

[75] Inventors: Thomas C. Smerchanski; Hans Boge, both of Winnipeg, Canada

[73] Assignee: Aerofoam Chemicals, Division of Border Chemical Company, Winnipeg, Canada

[21] Appl. No.: 942,797

[22] Filed: Sep. 10, 1992

[30] Foreign Application Priority Data

Oct. 9, 1991 [CA] Canada ..... 2053087

[51] Int. Cl.[5] ..... E04B 1/12

[52] U.S. Cl. ..... 52/98; 49/475.1; 52/309.4; 249/50

[58] Field of Search ..... 52/98–100, 52/396, 573, 309.4, 630; 49/475.1

[56] References Cited

U.S. PATENT DOCUMENTS

| | | | |
|---|---|---|---|
| 3,068,763 | 12/1962 | Harza | 52/396 X |
| 4,119,387 | 10/1978 | Brown | 52/396 X |
| 4,128,975 | 12/1978 | Abate | 52/309.4 X |
| 4,362,428 | 12/1982 | Kerschner | 49/475.1 X |
| 4,916,878 | 4/1990 | Nicholas | 52/396 |
| 4,999,960 | 3/1991 | Herwegh et al. | 52/396 X |

FOREIGN PATENT DOCUMENTS

| | | | |
|---|---|---|---|
| 245352 | 1/1961 | Australia | 52/309.4 |
| 2545206 | 4/1977 | Fed. Rep. of Germany | 52/309.4 |
| 3713361 | 11/1988 | Fed. Rep. of Germany | 52/396 |
| 546143 | 8/1922 | France | 52/100 |
| 604923 | 5/1960 | Italy | 52/98 |
| 6512581 | 3/1967 | Netherlands | 52/309.4 |
| 614059 | 12/1948 | United Kingdom | 52/100 |
| 999485 | 7/1965 | United Kingdom | 52/573 |
| 1380508 | 1/1975 | United Kingdom | 52/309.4 |

*Primary Examiner*—Lloyd A. Gall

*Attorney, Agent, or Firm*—Adrian D. Battison; Stanley G. Ade; Murray E. Thrift

[57] ABSTRACT

A support form for use in the casting of a grade beam on piles comprises an elongate rectangular body having a width equal to the intended width of the grade beam. The body is located under the intended grade beam and the grade beam cast on top of the form. The form is manufactured from polystyrene foam which is cut to form interior voids extending longitudinally of the body. The body prevents soil from entering the area underneath the grade beam. The body is formed with side walls having a wedging action and a collapsible central support so that a top wall of the body can collapse onto the bottom of the body if the forces from the soil due to exansion exceed a predetermined maximum force thus preventing the soil from causing heaving of the grade beam after installation.

20 Claims, 4 Drawing Sheets

SUPPORT FORM FOR A GRADE BEAM OR SLAB

BACKGROUND OF THE INVENTION

This invention relates to a form for supporting a building element relative to an underlying surface of soil material on which the element is to be mounted.

One type of construction of building includes the laying of a building element onto a ground surface with the building element being held in place so that it is at a fixed location. On top of the building element is then constructed the remainder of the building structure so that structure itself is also fixed in place and prevented from movement relative to other parts of the building.

In particular, but not exclusively, the building element is in the form of a cast concrete beam or slab which is laid upon supporting foundations, which may be piles but engages the surface of the ground or soil material forming the ground in between the foundations. The foundations act to hold the building element slab or grade beam in place. In many cases the grade beam or slab is cast in place by the formation of shuttering at the piles and extending across the piles following which the concrete is poured into the shuttering to form the grade beam or slab to a required height above the ground surface.

As is well known after the building is completed the soil material can swell due to the action of moisture or frost. At the sides of the grade beam, the soil movement simply causes sliding action of the soil past the grade beam with little tendancy to lift or heave the grade beam from its fixed position. However on the underside of the grade beam the soil material if it is forced upwardly with sufficient force can engage the grade beam sufficiently to cause heaving or lifting of the grade beam with consequential significant damage to the building structure or can cause cracking of a slab.

Three systems are currently available to resolve this problem and are relatively widely used in building systems of this type.

In the first system, the shuttering forming the grade beam is modified to include a horizontal panel above the ground surface so as to define a void between the underside of the completed grade and the upper surface of the soil. This void then allows the expansion of the soil material to occur without the soil material engaging the underside of the grade beam at all. This system is disadvantagous in that the initial shuttering or form work necessary for manufacture of the void is significantly more complicated than the conventional simple vertical panels and hence it is relatively expensive in labor costs. Furthermore the void can become filled with soil during the backfilling process thus losing the space between the underside of the grade beam and the upper surface of the soil and allowing the expansion to be transmitted from the soil to the grade beam to cause heaving.

In a second system, a rectangular body is laid on the soil surface prior to the location of the grade beam or the casting of the grade beam in place. One type of body for this system is manufactured from vertically extending cardboard sheets which are corrugated to provide sufficient strength in the vertical orientation during the initial casting or locating process but subsequently collapse under the increased load generated during the expansion process. This product is probably the most widely used product of this type but is unsatisfactory for a number of reasons. The main reason is that it tends to become weakened if wetted during the concrete casting process and can therefore collapse prematurely.

A third system provides a similar type of body which is located in place to provide the void and this product is made of organic material which is intended to decompose under the action of an applied enzyme. This product is unsatisfactory because it may fail by the fact that the decomposition may be too slow or inadequate and hence can transmit the compressive loads to cause the heaving of the grade beam.

Furthermore attempts have been made to replace the above products by a very light density foam material which is simply cut into a solid block of the foam of the required dimensions and is located in place under the grade beam as it is cast. This product is unsatisfactory in that the amount of displacement of the product is substantially directly proportional to the load applied so that there is some distortion during the initial loading during the casting of the beam and then as the loads increase during the expansion mode there is insufficient collapse to prevent transmission of the loads to the lifting of the beam. This product has therefore basically been rejected because the foamed material cannot provide the necessary parameters for compression of the product.

Up till now, therefore, there has been only relatively unsatisfactory solutions to this problem and while these solutions are widely in use, they certainly leave significant room for improvement if a product can be found therefore which provides the required collapse characteristics.

SUMMARY OF THE INVENTION

It is one object of the present invention, therefore, to provide a form for supporting a building element relative to an underlying surface of the soil material which can provide sufficient force for support of the building element as required during normal construction loadings but can collapse sufficiently to prevent transmission of forces from the soil due to normal expansion of the soil to the underside of the beam to avoid heaving of the beam.

According to the first aspect of the invention therefore, there is provided a form for supporting a building element relative to an underlying surface of soil material on which the element is to be mounted comprising a form body having an upper surface for receiving the building element thereon, the length and width of the upper surface being arranged to support a bottom surface of the element thereon, a bottom surface for resting on the surface of the soil material, two spaced side surfaces defining a height of the body, the side surfaces being shaped to maintain the soil material out from the volume defined generally between the upper surface and the lower surface, and two ends, the body being formed such that it provides sufficient strength in a vertical direction to maintain the upper and lower surfaces spaced by the height of the body up to a predetermined maximum load, beyond which the body collapses vertically to reduce the height of the body, the body being formed from a foamed plastics material having at least one void therein defined by the omission of the foamed material from the void arranged such that the collapse of the body causes the void to be at least partly filled by the foamed material to allow the reduction in height of the body.

According to a second aspect of the invention, therefore, there is provided a building construction comprising a building element having a substantially horizontal lower surface for support relative to an upper surface of soil material on which the building stands, and a form for supporting the elongate building element relative to the underlying surface of the soil material on which the element is mounted, the form comprising a form body having an upper surface receiving the building element thereon, the length and width of the upper surface being arranged to support a bottom surface of the element thereon, a bottom surface for resting on the surface of the soil material, two spaced side surfaces defining a height of the body, the side surfaces being shaped to maintain the soil material out from the volume defined generally between the upper surface and the lower surface, and two ends, the body being formed such that it provides sufficient strength in a vertical direction to maintain the upper and lower surfaces spaced by the height of the body up to a predetermined maximum load, sufficient to receive weight applied from the element onto the form body, the body being arranged such that beyond the maximum load caused by expansion of the soil material under the bottom surface of the element the body collapses vertically to reduce the height of the body, the body being formed from a foamed plastics material having at least one void therein defined by the omission of the foamed material from the void arranged such that the collapse of the body causes the void to be at least partly filled by the foamed material to allow the reduction in height of the body.

One or more embodiments of the invention will now be described in conjunction with the accompanying drawings.

BRIEF DESCRIPTION OF THE DRAWINGS

In the drawings like characters of reference indicate corresponding parts in the different figures.

DETAILED DESCRIPTION

Figure 1:
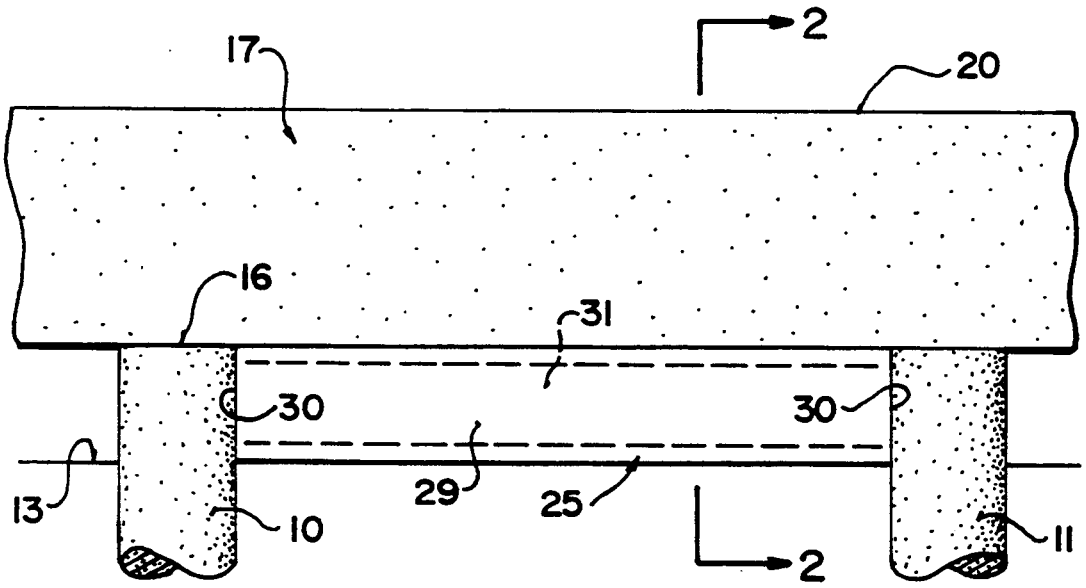
FIG. 1 is a side elevational view of a grade beam laid upon a plurality of piles and including the form for supporting the underside of the grade beam relative to the upper surface of the soil material on which the building stands.
Figure 2:
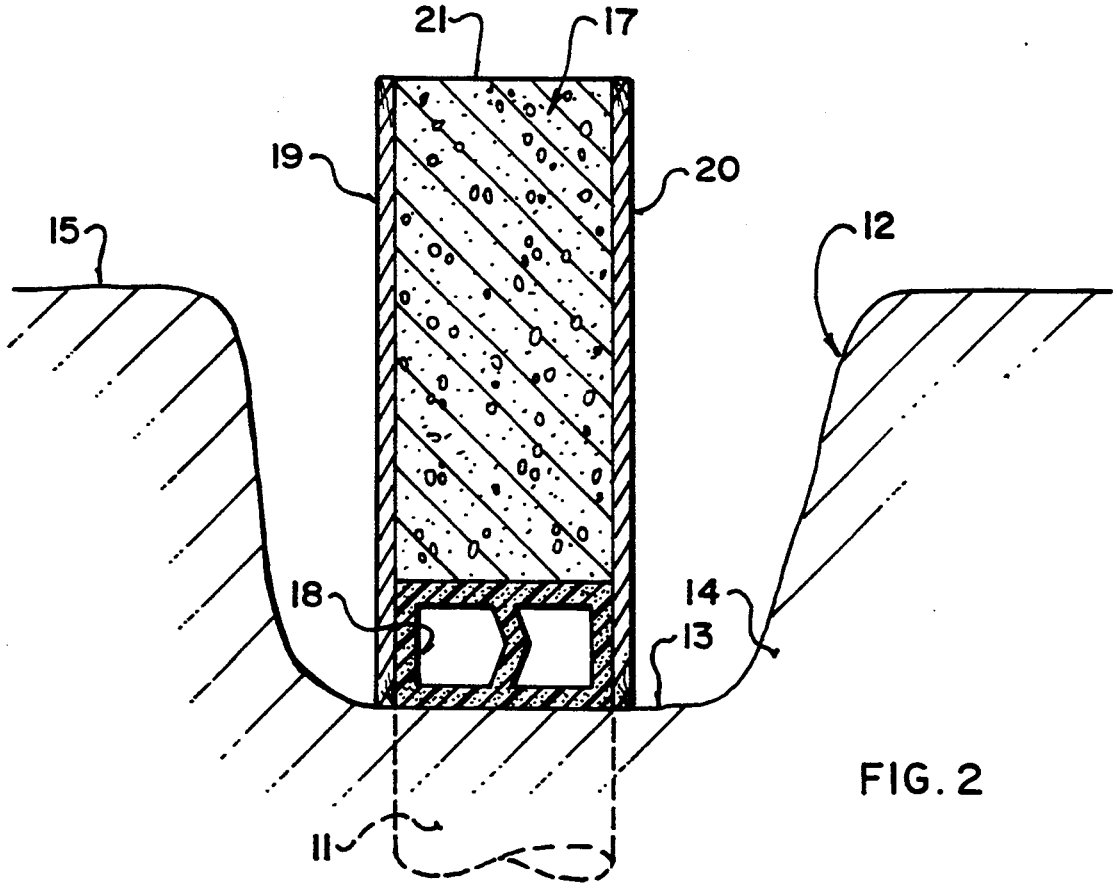
FIG. 2 is a cross sectional view along the lines 2—2 of FIG. 1 showing the grade beam and support form during the construction process.
Figure 3:
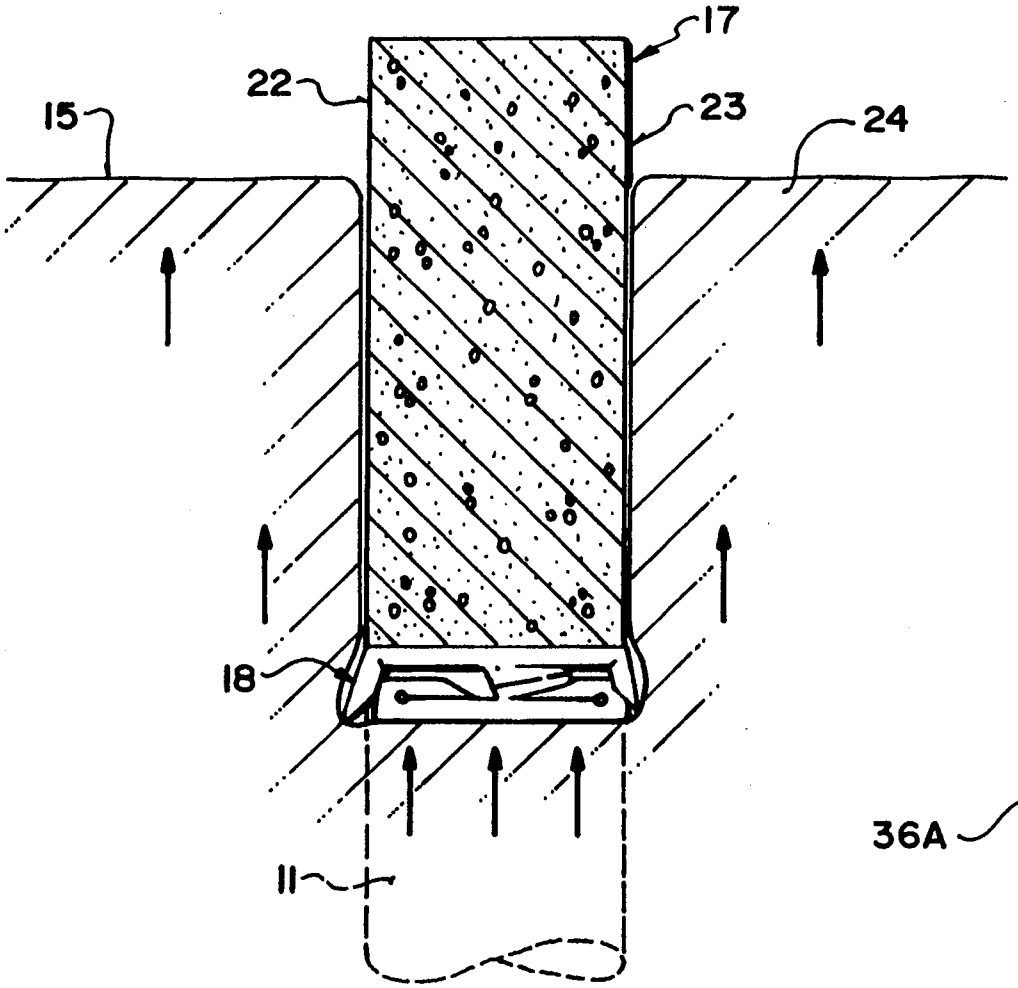
FIG. 3 is a cross sectional view similar to that of FIG. 2 showing the building element and support form subsequent to the completion of construction and during the collapse mode caused by upward expansion of the soil material.

The building construction shown in FIGS. 1, 2 and 3 comprises a plurality of piles 10, 11 which are spaced longitudinally of an intended wall of the building. An upper end of the pile is located within a trench 12 defining an upper surface 13 of the soil material 14 at the bottom of the trench. The trench is excavated from a ground level 15 downwardly into the ground so that the piles have an upper end 16 located below ground level.

A grade beam 17 is located on top of the piles so as to span the piles and form a structural support beam for the remainder of the building.

The grade beam 17 can be formed as a slab of precast material preferably concrete. However more preferably it is cast in place to form a vertical concrete wall of a width suitable to support the wall of the building generally in the range six to nine inches, of a length equal to the length of the intended wall and a height so as to extend from the top of the piles to a location adjacent the intended floor of the building.

As shown in FIG. 2, the support form of the present invention is indicated at 18 and is located directly under the grade beam 17. A pair of parallel panels 19 and 20 are shown defining shuttering for the formation of the concrete grade beam to be cast in place. The shuttering or panels 19 and 20 extend from the intended height of the top of the grade beam indicated at 21 to a position on either side of the form 18 and extending generally to the ground surface 13.

After the concrete has been poured and given sufficient time to set, the panels 19 and 20 are removed leaving the vertically standing concrete grade beam suitably located for receiving the remaining structure of the building supported on the top surface of the grade beam. The trench 12 is then backfilled to achieve the position shown in FIG. 3 in which the grade beam is engaged on the outside surface 22 by the ground on the outside of the building and on an inside surface 23 by a filling material 24 located inside the building.

Figure 4:
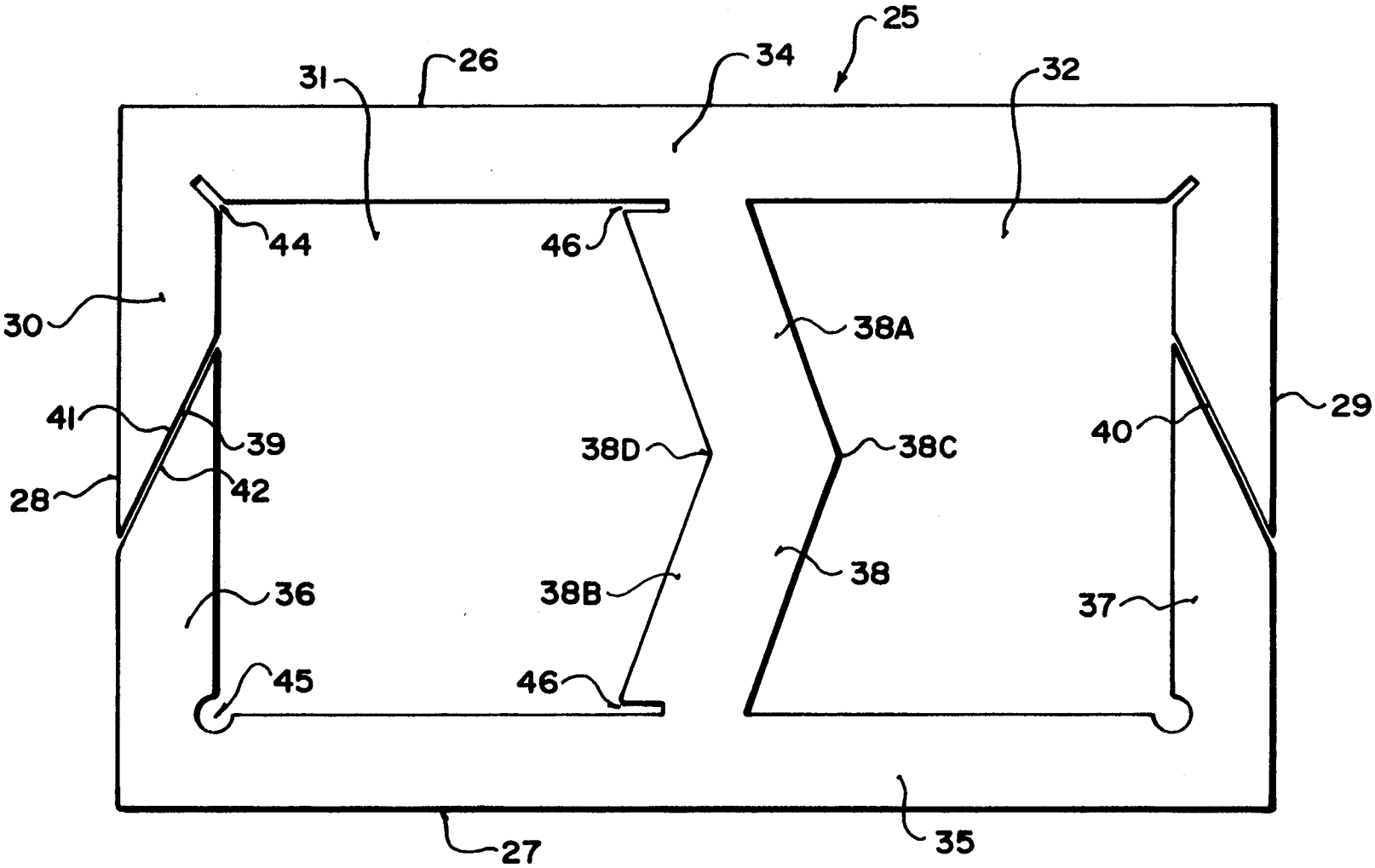
FIG. 4 is an end elevational view of the support form of FIGS. 1, 2 and 3.

The structure of the support form is shown in more detail in FIG. 4. The support form comprises an elongate body generally indicated at 25 including a planar upper surface 26, a planar lower surface 27, a first planar side surface 28 and a second planar side surface 29. The body is thus rectangular in elevation and is elongate as shown in FIG. 1 so as to define ends 30 only one of which of course is visible in FIG. 4. The body has a constant cross sectional shape. The upper surface 26 is designed to receive the underside of the beam 17 so that it has a width equal to the intended width of the grade beam, which as stated above can be of the order six to nine inches. The lower surface 27 is directly parallel to the upper surface 26 and is arranged for resting upon a flat upper surface of the soil material. The side surfaces 28 and 29 are shaped so as to prevent the entry of soil material into the area underneath the underside of the grade beam that is into the volume defined generally between the upper surface 26 and the lower surface 27.

The body 25 is formed from a suitable foamed plastics material which is most preferably polystyrene foam which has the characteristics that it is relatively inexpensive, easily formed and can provide the required characteristics of density and frangibility as described hereinafter.

The body is formed with a first and a second interior void indicated at 31 and 32 respectively. Each of the voids extends longitudinally of the body so as to break out at the ends 30 as shown in FIGS. 1 and 4.

The voids are located and shaped relative to the outside surfaces of the body so as to define an upper wall 34, a lower wall 35, a side wall 36, a second side wall 37 and a central support element 38 dividing or separating the two voids each from the other. The upper wall 34 defines the upper surface 26 and extends across the full width of the upper part of the body. The lower wall similarly defines the lower surface 27 and also extends across the full width of the body. The side walls 36 and 37 cooperate with the central support element 38 to support the top wall 34 relative to the bottom wall 35 so as to maintain an initial height of the body defined by the upper surface and the lower surface 27.

In the initial condition of the body with the surfaces supported at the initial height of the body, the body is located in the operating position shown in FIG. 2 and the concrete wall poured. The support elements 36, 37 and 38 are arranged to have sufficient strength to support the top wall away from the bottom wall at the full height of the body during the initial casting or laying process. The use of the relatively dense foam for the formation of the product thus maintains it substantially rigid and without any deformation during the initial casting process.

The side walls 36 and 37 are each formed with a slot 39, 40 which is formed along the full length of the side wall and is cut at an angle to the side surface so that the slot forms a lower surface 41 on an upper part of the side wall and an upper surface 42 on a lower part of the side wall with those surfaces lying closely adjacent or abutting but inclined to the horizontal so that the vertical force on the upper part of the side wall tends to cause a sliding action of the lower surface 41 on the upper surface 42. The slot 39, 40 is sufficiently thin so that the soil material cannot penetrate into the void. The provision of the slot also is of advantage in that it enables the body to be cut to form the void in a shape as shown and described hereinafter by the use of an elongate hot wire system with the wire extending longitudinally of the body, passing into the body through the slot and then cutting a slot through the body to define the void shape following which the material within the void is pulled out of the body longitudinally through one end of the body to complete the formation of the void by the removal of the foamed material at that point. The removed material can be recycled or can be used for other structures.

At the junction between the side walls 36 and the top wall 34 is provided a narrow slot portion 44 which extends from the junction toward the corner of the body so as to render the junction between the top wall and the side wall more readily frangible. Thus a fracture can occur at the corner by cracking of the foamed material across the corner from the slot 44 directly to the corner. At the bottom of the side wall at the junction between the side wall and the bottom wall is provided a part cylindrical void 45 which again extends from the junction toward the outer corner of the body.

The central support element 38 is defined by material remaining after the removal of the two voids and is thus integrally formed with the top wall 34 and the bottom wall 35. The element 38 is formed so as to define upper portions 38A and a lower portion 38B which are angled to form an elbow or corner 38C on one side and a recessed V shape 38D on the other side. This allows the support element to break or fracture at the elbow by vertical compression forces applied between the bottom wall and the top wall. In addition further slots 46 are cut at the junction between the element 38 and the top and bottom walls respectively on the side of the junction adjacent the inside V shape 38D again to allow more ready fracture of the support element from the top and bottom walls during the bending process at the elbow 38C.

Figure 5:
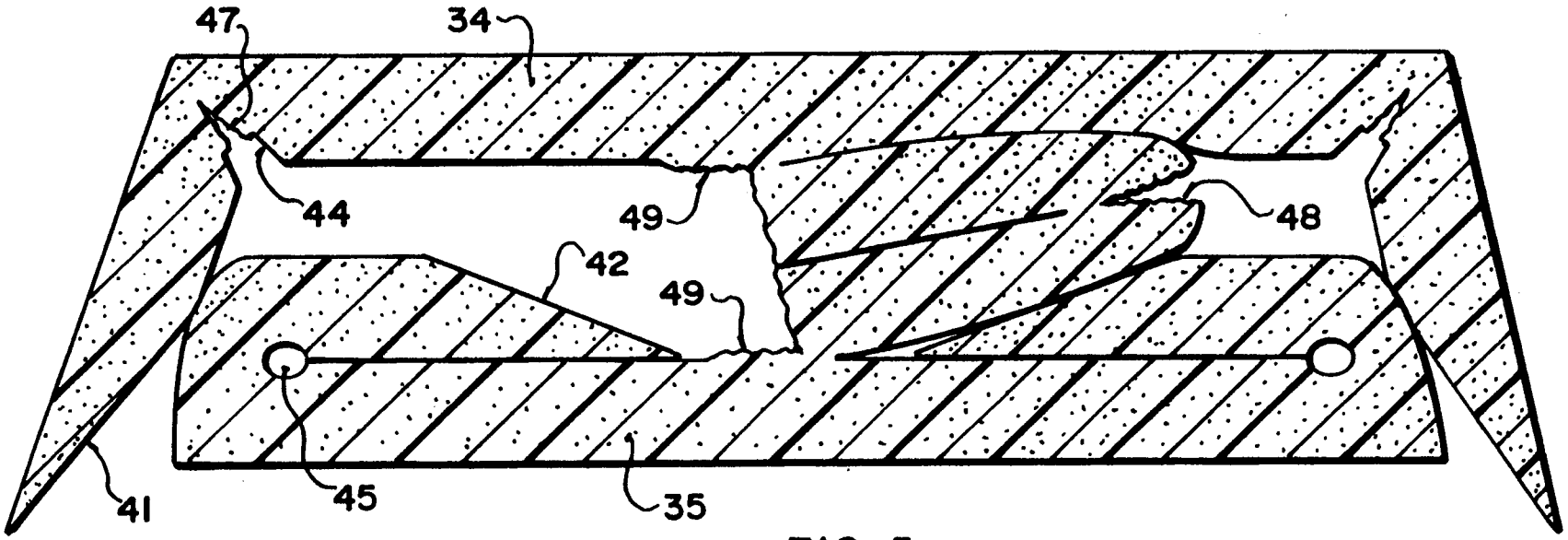
FIG. 5 is a cross sectional view of the support form of FIG. 4 shown in a collapsed condition.

The position of the body after the maximum acceptable load has been exceeded and the body thus collapsed is shown in FIG. 5. After the maximum acceptable load has been exceeded, the surfaces 41 and 42 gradually slide relative to one another so as to force the upper part of the side wall outwardly while the lower part of the sidewall is forced inwardly. This tends to cause a fracture or crack 47 at the slot 44 as the upper part is forced outwardly beyond the outer edge of the bottom wall 35. At the same time the lower part of the side wall is folded inwardly by the pressure of the inside surface of the upper part of the side wall to take up a position between the bottom wall 35 and the top wall 34.

As the surfaces 41 and 42 slide, more and more force is applied to the central support element 38 which then constitutes the sole support of the upper surface 26 relative to the bottom surface 27. At the point of maximum load, the elbow 38C fractures as indicated at 48 and similarly the slots 46 cause a further fracture 49 to occur at the junction of the support element 38 with the top and bottom walls respectively. Thus once the fracture has occured, the body is free to collapse vertically to take up the position shown in FIG. 5 in which the top wall 34 lies closely adjacent the bottom wall 35 and substantially fills the voids previously present in the body.

In many conditions of use of the support form of the present invention, it is desirable that the body collapse to a height which is of the order of six inches less than the height of the body in the original condition. This provides six inches of expansion of the soil relative to the grade beam without the danger of heaving of the grade beam. The thickness of the walls and the thickness of the support element 38 can thus be selected by cutting the voids to the required dimensions so that the body can collapse from an initial height of the order of the eight inches to a collapsed height of the order of two inches. Thus the voids provide at least fifty percent of the volume of the body so that the body can collapse to a height at least fifty percent less than the initial height. It is preferred as stated above that the amount of collapse is greater than fifty percent but in some conditions a collapse of this amount would be acceptable without providing a form of initial height which is so high as to be impractical.

The method by which the collapse occurs in the embodiment of FIG. 4 is due to the initial wedging action of the two side walls followed by the ready frangibility of the central support caused by the angle of the support and the provision of the notches or slots which allow the fracture to occur.

However other designs of frangible or fracturable arrangements can be provided. In one example, intermeshing elements may be provided which are held together by a narrow band of the material so that the band can fracture and allow the remaining body parts to intermesh to the collapsed condition. In other arrangements the wedging action can provide both the required support and the complete collapse by forcing the side walls outwardly.

However in all cases the relationship between distortion and load applied is significantly non linear in that under low loads of the type during the initial installation, substantially no distortion occurs. However once the maximum load is achieved, the collapse occurs rapidly and without the necessity for significant increase in load above the maximum load.

The product is easy to handle in that it is resistant to damage during the rough handling normally involved in a construction environment. The provision of the frangible parts allows the body thus to be normally relatively rigid and resistance to damage but to fracture and to compress readily once the maximum load has been achieved.

The length and width of the product can be selected in accordance with the requirements of the beam to be formed. In some cases where the beam is particularly wide, two forms can be laid side by side to achieve the required width.

Figure 6:
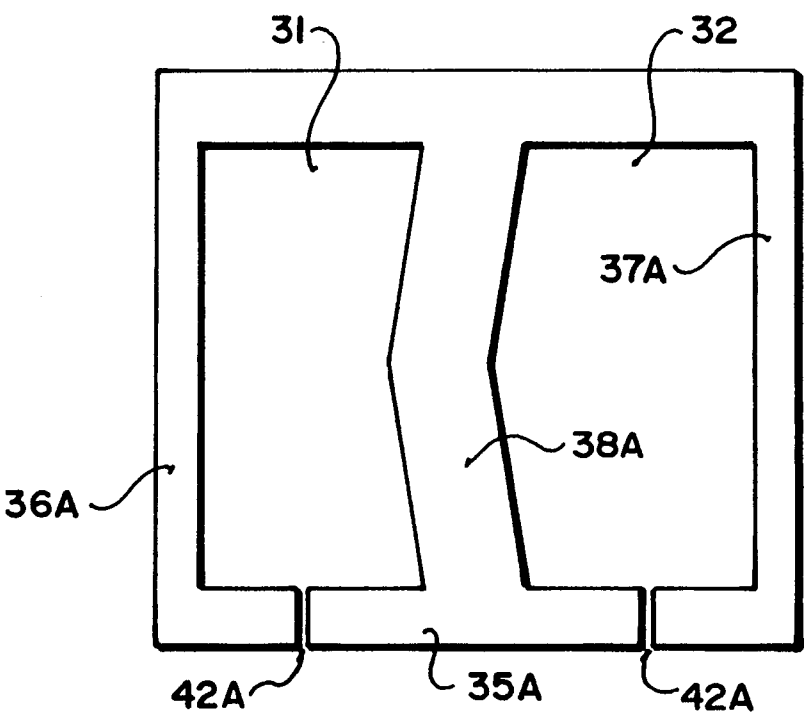
FIG. 6 is an end elevational view similar to that of FIG. 4 showing a modified arrangement of the form.

Turning now to FIG. 6, there is shown an alternative arrangement of the form as previously described. The major modification between the form of FIG. 4 and that of FIG. 6 is that the entry slots 42A which allow the cutting wire to enter into the area of the voids 31 and 32 is placed in the bottom wall 35A rather than in the sidewalls 36A and 37A. In this position the slots 42A do not assist the collapse of the structure but are simply there as a result of the cutting process. In this case the fracture or collapse occurs due to the collapse of the central supporting elements 38A which is angled as previously described together with the fracture of the sidewall 36A and 37A. The collapse of the sidewalls is effected as a result of the collapse of the central support structure 38A and in this arrangement the sidewalls 36A and 37A can be thinner than those of the embodiment of FIG. 4.

Figure 7:
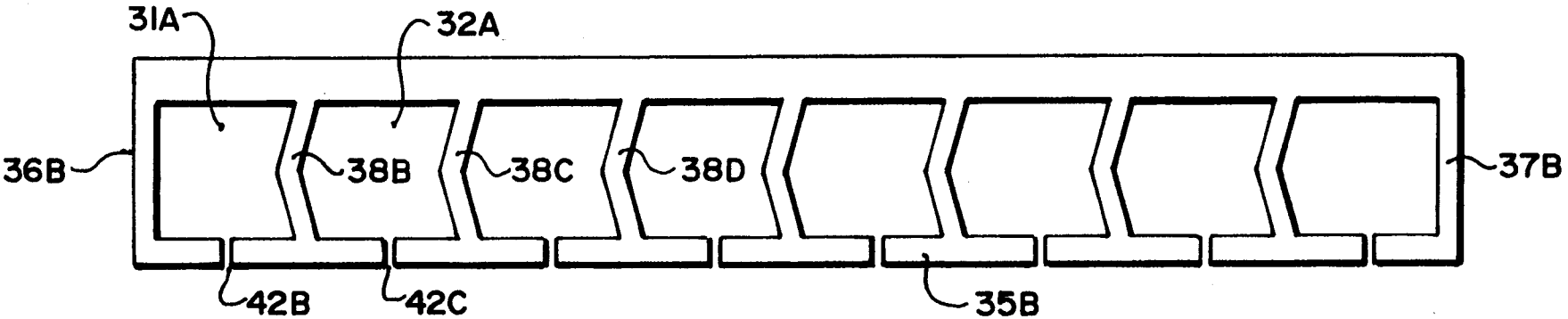
FIG. 7 is an end elevational view of a modified form for use with a slab.

In FIG. 7 is shown an arrangement which is expanded by the addition of further central support structures 38B, 38C, 38D et seq. The arrangement is therefore effectively a multiplication of the arrangement shown in FIG. 6 except that of course the sidewalls 36B and 37B are arranged only at the sides of the form and the intermediate support structures are provided by the angled elements 38B et seq. The bottom wall 35B is cut by the pressure of the slots 42B, 42C et seq, each of which connects with the respective void 31A, 32A, divided by the respective support structure 38B.

The form shown in FIG. 7 is arranged to have a width preferably of the order of 4 feet and a length of the order of 8 feet which is a conventional size in construction so that these forms can be laid on a flat ground surface to provide the support for casting a slab of a required dimension. If the slab is greater in size than the form, of course more than one form can be used end to end or side to side as required. The mechanism for the collapse of the forms is as previously described except that the collapse of one of the central support structures 38B etc., acts as a domino effect on the remaining support structure so that each in turn will collapse if the force at that point exceeds the maximum allowable force as previously described.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A method of forming a building construction on an upper surface of soil material on which the building construction is to stand, the method comprising providing a form body for supporting a building element relative to the upper surface of the soil material, forming the form body from a fracturable foamed plastics material, defining on the form body a top wall having an upper surface for receiving the building element thereon, the length and width of the upper surface being arranged to engage and support a bottom surface of the element thereon, a bottom wall defining a lower surface resting on the surface of the soil material, a plurality of interconnecting elements extending between and interconnecting the top wall and the bottom wall so as to support the top wall on the bottom wall, the interconnecting elements defining two spaced side surfaces defining a height of the body, the side surfaces being shaped to maintain the soil material out from the volume defined generally between the upper surface and the lower surface, the interconnecting elements being substantially continuous along the length of the upper surface and defining therebetween at least one void defined by the omission of the foamed plastics material extending along the elements, the interconnecting elements being shaped and arranged such that they provide sufficient strength in a vertical direction to maintain the upper and lower surfaces spaced by the height of the body up to a predetermined maximum load, applying the building element onto the upper surface so that weight therefrom is applied to and supported by the upper surface, and shaping and arranging the interconnecting elements such that they fracture on expansion of the soil material under the bottom surface of the building element generating a load greater from said predetermined maximum load to cause the body to collapse vertically to reduce the height of the body and absorb the expansion of the soil material.

2. The method according to claim 1 including defining said body such that said at least one void extends longitudinally of the body and breaks out at ends of the body.

3. The method according to claim 1 including defining said body such that the side surfaces are substantially free from openings allowing passage of soil material into said at least one void.

4. The method according to claim 1 including defining said body such that the total volume of said at least one void is at least one half of the total volume of the body.

5. The method according to claim 1 including shaping the interconnecting elements with notch means therein to assist in the fracture thereof.

6. The method according to claim 1 including shaping and arranging the interconnecting elements to includes at least one central element therebetween two side elements, the central element being formed from two portions arranged at an angle so as to allow ready fracturing of the central element at the angle between the two portions.

7. The method according to claim 1 wherein the foamed plastics material is formed from polystyrene foam.

8. The method according to claim 1 including pouring the building element onto the upper surface of the form from cast concrete.

9. The method according to claim 1 including supporting the building element upon a plurality of spaced piles and positioning the form under the building element so as to extend from one pile to a next adjacent pile.

10. A building construction comprising a building element having a substantially horizontal lower surface for support relative to an upper surface of soil material on which the building stands, and a form supporting the building element relative to the underlying surface of the soil material on which the element is mounted, the form comprising a form body formed of a foamed plastics material having a top wall defining an upper surface receiving the building element thereon, the shape of the upper surface being arranged so as to engage and support a bottom surface of the element thereon, a bottom wall defining a lower surface resting on the surface of the soil material, a plurality of interconnecting elements extending between and interconnecting the top wall and the bottom wall so as to support the top wall on the bottom wall, the interconnecting elements defining two spaced side surfaces defining a height of the body, the side surfaces being shaped to maintain the soil material out from the volume defined generally between the upper surface and the lower surface, the interconnecting elements being substantially continuous along the length of the upper surface and defining therebetween at least one void extending along the elements defined by the omission of the foamed plastics material, the interconnecting elements being shaped and arranged such that they provide sufficient strength in a vertical direction to maintain the upper and lower surfaces spaced by the height of the body up to a predetermined maximum load sufficient to receive weight applied from the element onto the form body, the interconnecting elements being shaped and arranged and the foamed plastics material being fracturable such that upon application of a load greater than the maximum load, caused by expansion of the soil material under the bottom surface of the building element, the interconnecting elements fracture causing the body to collapse vertically to reduce the height of the body, with the void at least partly filled by the foamed plastics material to allow the reduction in height of the body.

11. The building construction according to claim 10 wherein said at least one void extends longitudinally of the body and breaks out at ends of the body.

12. The building construction according to claim 10 wherein the side surfaces are substantially free from openings allowing passage of soil material into said at least one void.

13. The building construction according to claim 10 wherein the total volume of said at least one void is at least one half of the total volume of the body.

14. The building construction according to claim 10 wherein said at least one void is designed to allow collapse of the height of the body by a proportion substantially equal to the proportion of total volume of said at least one void relative to the total volume of the body.

15. The building construction according to claim 10 wherein the interconnecting elements include notch means therein to assist in the fracture thereof.

16. The building construction according to claim 10 wherein the interconnecting elements include at least one central element between two side elements, the central element being formed from two portions arranged at an angle so as to allow ready fracturing of the central element at the angle between the two portions.

17. The building construction according to claim 10 wherein the foamed plastics material is polystyrene foam.

18. The building construction according to claim 10 wherein the building element is formed from cast concrete.

19. The building construction according to claim 18 wherein the cast concrete building element is cast in place onto the support form.

20. The building construction according to claim 10 wherein the building element is supported upon a plurality of spaced piles and wherein the form is positioned under the building element so as to extend from one pile to a next adjacent pile.

* * * * *